United States Patent [19]

Watson

[11] Patent Number: 4,549,679

[45] Date of Patent: Oct. 29, 1985

[54] METHOD FOR SLITTING AMORPHOUS METAL

[75] Inventor: Bruce R. Watson, Hickory, N.C.

[73] Assignee: General Electric Company, King of Prussia, Pa.

[21] Appl. No.: 574,233

[22] Filed: Jan. 26, 1984

[51] Int. Cl.[4] ..... B26F 3/00

[52] U.S. Cl. ..... 225/2; 225/96.5

[58] Field of Search ..... 225/2, 96.5, 93

[56] References Cited

U.S. PATENT DOCUMENTS

| | | | |
|---|---|---|---|
| 4,155,397 | 5/1979 | Honsinger et al. | 29/609 X |
| 4,328,411 | 5/1982 | Haller et al. | 225/2 X |
| 4,356,377 | 10/1982 | Norton et al. | 219/121 EH |

OTHER PUBLICATIONS

J. M. C. Li, Chapter 9, pp. 224–246, of the book "Metallic Glasses", published in 1978 by The American Society for Metals, Metals Park, Ohio.

*Primary Examiner*—Frank T. Yost

*Attorney, Agent, or Firm*—William Freedman

[57] ABSTRACT

A strip of amorphous metal is separated into first and second strips by scribing a line in a surface of the strip, thus defining first and second parts of said strip located on opposite sides of said scribed line folding and moving said parts of the strip together along the scribed line in the direction which encloses the scribed line close enough to form a crease and then at least partly flattening the strip. The strip separates into the first and second strips as the flattening operation proceeds along the strip. The facing cut edges of the first and second strips are moved apart once they are separated. To extend the life of the scribing tool, the flattening step may be extended to include reversing the crease.

21 Claims, 8 Drawing Figures

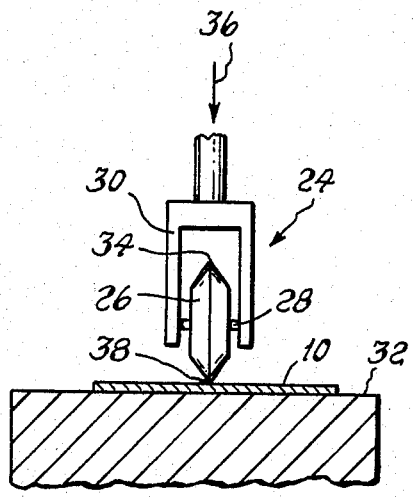
Fig. 5
Fig. 6
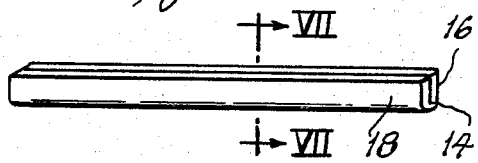
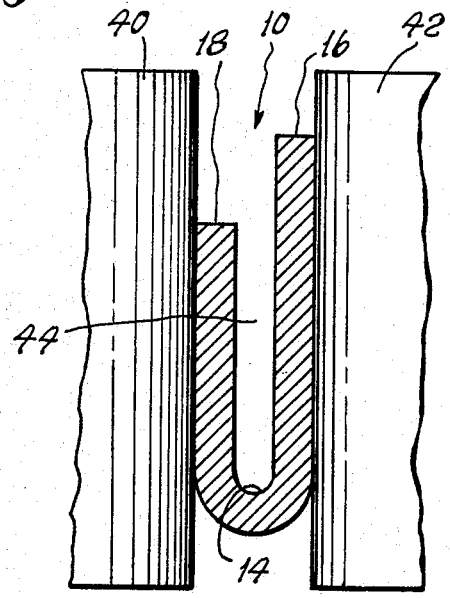
Fig. 7
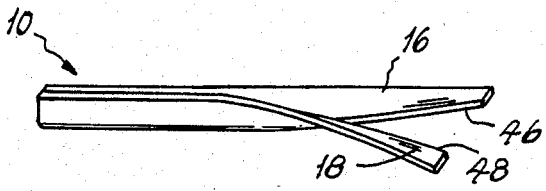
Fig. 8

METHOD FOR SLITTING AMORPHOUS METAL

BACKGROUND

The present invention relates to amorphous metals and, more particularly, to a method for slitting an amorphous metal foil.

The invention herein disclosed is based upon work sponsored in part by the Electric Power Research Institute, Palo Alto, Calif.

Amorphous metals are metal alloys in which the usual crystalline structure is not present. A resume of amorphous metal materials and their properties is contained in a paper entitled *METALLIC GLASSES: A MAGNETIC ALTERNATIVE,* by Donald Raskin and Lance A. Davis, published in IEEE Spectrum, November 1981, the contents of which are herein incorporated by reference. In brief, an amorphous metal is formed by cooling a molten alloy at such a high rate (typically exceeding a million degrees per second) that the usual crystalline structure of the metal does not have time to form. Instead, the metal is frozen into a metastable condition in which the disorder of the molten form is preserved.

Amorphous metals exhibit a number of differences in their properties from the normal crystalline form of the same alloy which make them especially suitable for certain applications. They are harder, more abrasive and more sensitive to mechanical stresses, have higher mechanical strength, flexibility and electrical resistivity than their crystalline forms and some alloys of amorphous metal exhibit the softest magnetic characteristics of any known materials. This latter property is especially desirable for magnetic core materials since the ease with which a magnetic material is magnetized and demagnetized controls the hysteresis losses experienced when the magnetic material is repetitively magnetized first in one direction and then in the other direction as is customarily the case for magnetic core materials in AC machinery.

An AC distribution transformer, for example, has its primary winding permanently connected to the AC line. Thus, the primary winding continuously cycles the transformer core between extremes of magnetic intensity. The repetitive traversing of the hysteresis loop of the transformer core produces hysteresis losses which must be made up by primary power. These hysteresis losses represent an overhead cost of operating the transformer which is independent of load. Even during periods of light or zero secondary loading, power must be fed to the primary to supply the hysteresis losses in the transformer core. Substitution of a suitable amorphous metal for the magnetic steel normally used in transformer cores can reduce this hysteresis overhead by a factor of 4 or more.

Amorphous metals also have characteristics which have heretofore interfered with their use. One of the problems in amorphous metals made by the above-referenced process arises because the need for an extremely rapid cooling rate during the casting of a strip of amorphous metal dictates that the amorphous metal strip must be extremely thin. Thicknesses of about 0.076 mm are about the maximum which can be produced, with more typical values on the order of from about 0.025 to about 0.05 mm. Normal transformer core laminations are about ten times thicker. Thus, about ten times as many layers of amorphous metal are required to form a transformer core of the same cross section as are required with the steel laminations of the prior art.

Space factor is important in many magnetic cores. Space factor is defined as the ratio of the actual volume of core material to the physical volume consumed by the core. If the layers making up the core do not lie flat upon each other but instead remain separated by air or other non-magnetic material, the physical volume consumed by the core increases without a corresponding increase in magnetic properties. If burrs or irregularities are present on the edges or surfaces of the core laminations, the laminations do not lie flat and consequently the space factor is degraded. The thinness dictated by the way amorphous metals are made adds to the problem. For example, edge burrs and/or surface irregularities which are small enough to be ignored on the edges of conventional core laminations may cause severe degradation in the space factor when ten or more times as many layer are used.

Amorphous materials are so hard and abrasive that it is extremely difficult to cut the as-cast strip into the sizes and shapes needed to form a core. Conventional cutting techniques include, for example, slitting with rotary shearing devices, scissors-type cutters and pinch-type cutters, all of which rely on sharp cutting edges for clean cuts. The required sharp cutting edges of these devices rapidly degrade due to the hard abrasive material being cut, even when the cutting edges are made of hard materials such as, for example, an appropriate tungsten carbide. Wheel-type slitting devices also suffer from the thinness of the amorphous metal strip. That is, if the amorphous metal strip is, for example, about 0.038 mm thick, then the cutting wheels must be set for a clearance on the order of 0.0051 mm or less. Such tolerances call for the best, and most expensive, attainable tolerances and, even when such tolerances are attained, the cutting must be performed under controlled temperature conditions. When the cutting edges wear, they begin to produce kerfs or burrs which prevent successive layers of a core from laying in complete contact with each other and thus result in degraded space factor.

U.S. Pat. Nos. 4,328,411 and 4,356,377 disclose laser and/or electron beam cutting techniques for forming complex shapes by either melting and cutting completely or partially through an amorphous strip or heating it above its crystallization temperature so that the desired cutting line assumes the brittle crystalline form of the alloy which can thereafter be easily broken to separate the desired shape from the remainder of the strip. Although these techniques avoid the degradation in edge quality resulting from worn cutting edges of cutting tools, they still produce reduced space factor due to edge burrs. In addition, the heating that these techniques produce along the cutting line leaves crystallized alloy with a resulting degradation of the magnetic properties in these areas which use of the amorphous material is intended to provide.

OBJECTS AND SUMMARY

An object of the invention is to provide a method for cutting strips of brittle and very hard amorphous alloy that is characterized by clean, burr-free edges without the production of crystallized alloy at the edges.

Another object of the invention is to provide a method for cutting strips of amorphous metal which takes advantage of the characteristics of the amorphous metal itself to produce the cut.

A further object of the invention is to provide a method for cutting strips of amorphous metal of unlimited length.

A still further object of the invention is to provide a method for cutting a strip of amorphous metal into two strips along a cutting line which is defined by a scribe line on the strip.

A yet further object of the invention is to provide a method for cutting a strip of amorphous metal into two strips along a line of indefinite length without requiring special environmental control.

According to an embodiment of the invention, there is provided a method for slitting a strip of amorphous metal comprising scribing a line in a first surface of the strip, folding the parts of the strip on opposite sides by said line toward each other along the line to form a folded strip having the line within the fold and defining an apex of the fold, creasing the fold and at least partially flattening the folded strip whereby the strip separates into first and second strips on opposed sides of the line.

According to a feature of the invention, there is provided a method for slitting a strip of amorphous metal comprising backing up a first surface of the strip with a hard unyielding back-up surface, drawing a cutting edge of a wheel-type scribing tool along a cutting line on a second surface of the strip, applying a scribing force on the wheel-type scribing tool effective to compress a line of the amorphous metal beneath a cutting edge of the wheel-type scribing tool to thereby form a depressed scribed line between first and second parts of said strip located on opposite sides of said line, spacing first and second parallel surfaces of first and second mandrels a predetermined distance apart, folding said first and second parts of the strip toward each other with the scribed line enclosed therebetween, drawing the strip between the first and second parallel surfaces whereby a crease is formed in the strip along the scribed line, progressively at least partly flattening the crease along the scribed line whereby the strip separates into first and second strips on opposed sides of the scribed line and separating the first and second strips during the step of progressively at least partly flattening whereby cut edges of the first and second strips are moved apart.

Briefly stated, the present invention provides a method wherein a strip of amorphous metal is separated into first and second strips by scribing a line in a surface of the strip, folding and creasing the strip along the scribed line in the direction which encloses the scribed line and then at least partly flattening the strip. The strip separates into the first and second strips as the flattening operation proceeds along the strip. The facing cut edges of the first and second strips are moved apart once they are separated. The flattening operation may be continued until the crease is completely flattened or the crease may even be partly or completely reversed.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5 is a cross section of an amorphous strip and a back-up surface showing one type of scribing tool which may be employed in the practice of the method.

FIG. 6 is a perspective view of a folded and creased strip of amorphous alloy.

FIG. 7 is a cross section taken along VII—VII of FIG. 6 and showing a pair of opposed mandrels for creasing the strip.

FIG. 8 is a perspective view showing the flattening and separating parts of the method in progress.

DETAILED DESCRIPTION OF THE PREFERRED EMBODIMENT

Figure 1:
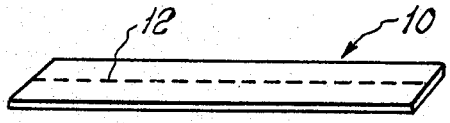
FIG. 1 is a perspective view of a strip of amorphous metal to be separated into two strips along a substantially straight line.

Referring now to FIG. 1, there is shown, generally at 10, a strip of amorphous metal alloy 10. Although the present invention should not be considered to be limited to a particular alloy, for concreteness of description, one alloy with which the method of the invention has been used, and which is employed as an exemplary material upon which the following description is based, is identified as alloy 2605 S-2 manufactured by Allied Corp., and consisting of about 78 percent iron, 13 percent boron and 9 percent silicon. Use of the method disclosed herein with other suitable amorphous metal alloys should also be considered within the spirit and scope of the present invention. Strip of amorphous metal alloy 10 may be as long as convenient and may have a width as wide as can be cast using known or to-be-developed manufacturing techniques. A desired cutting line 12 is indicated in dashed line. Although cutting line 12 is shown to be straight and aligned with the length dimension of strip of amorphous metal alloy 10, a substantial curvature may be accommodated in cutting line 12 and the method of the present invention is successfully performed irrespective of the angle of cutting line 12 with respect to the length dimension of strip of amorphous metal alloy 10. That is, cutting line 12 may be oriented parallel to the length dimension as shown, normal to the length dimension, or at any angle in between.

Figure 2:
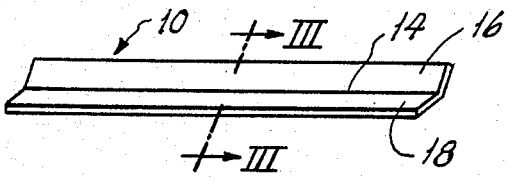
FIG. 2 is a perspective view of the strip of amorphous alloy of FIG. 1 after receiving a scribed line in one surface thereof.
Figure 3:
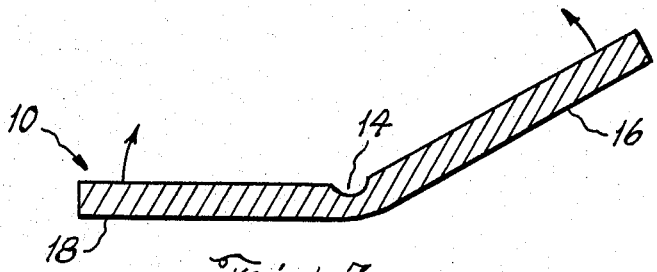
FIG. 3 is a cross section taken along III—III of FIG. 2.

Referring now to FIG. 2, a scribe line 14 is formed along the line previously defined by cutting line 12. Scribe line 14 divides strip of amorphous metal alloy 10 into first and second parts 16 and 18 which typically fold slightly toward each other about scribe line 14. Referring now also to the cross section in FIG. 3, scribe line 14 forms a depression in strip of amorphous metal alloy 10. If strip of amorphous metal alloy 10 were of normal crystalline material, the formation of scribe line 14 would deform the material of the strip by pressing it to the sides and upward along scribe line 14 to form parallel linear mounds or berms. Such mounds or berms, if they existed, would degrade space factor. As shown in FIG. 3, however, the edges of scribe line 14 do not exhibit more than insignificant mounds, but instead, are substantially flat and parallel to the surfaces of part 16 and part 18.

Figure 4:
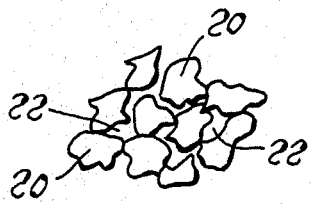
FIG. 4 is a microscopic view of the amorphous alloy material.

Although I do not intend that the method of the present invention should be limited to any particular causal theory, I presently believe that the way in which the structure of strip of amorphous metal alloy 10 differs from the normal crystalline form of the alloy accounts for the form of scribe line 14 shown in FIG. 3. When a normal crystalline form of an alloy solidifies, the crystals thus formed reorient themselves as necessary to produce a substantially solid piece of metal with few, if any, voids. Conversely, when the alloy is rapidly cooled to form strip of amorphous metal alloy 10, instead of having time to rearrange itself to produce a solid, the alloy is trapped in a metastable amorphous state consisting of alloy particles such as shown at 20 in FIG. 4 with a percentage of the volume consisting of voids 22 distributed throughout the mass of the material. The sizes of particles 20 and voids 22 are, in fact, on the atomic scale but are exaggerated in FIG. 4 for purposes of explanation. When scribe line 14 is formed, voids 22 may be displaced laterally away from scribe line 14. This displacement may nucleate cracks on the side of strip of amorphous metal alloy 10 opposite to the side being contacted by the tool forming scribe line 14 in the regions alongside scribe line 14 to which voids 22 are displaced. This permits the formation of scribe line 14 without displacing material to the sides and upward. The resulting line of nucleated cracks alongside scribe line 14 do not propagate into the surrounding material on their own, but instead, must await a certain type of tensile stress to mature and permit separation of the material along scribe line 14.

Scribe line 14 may be formed by any convenient tool such as an awl, a knife edge and the like. Even though the material of strip of amorphous metal alloy 10 is hard and abrasive, the fact that scribe line 14 does not have to penetrate strip of amorphous metal alloy 10, but only contact and press against its surface, substantially reduces tool wear as compared to a cutting method where penetration of the strip exposes the cutting tool to cut edges of the strip. I have found that a wheel-type cutter of a type similar to a glass cutter, such as shown at 24 in FIG. 5, is particularly effective for forming scribe line 14. A wheel 26 is rotatably supported on an axle 28 between legs of a yoke 30. A back-up surface 32 supports strip of amorphous metal alloy 10 which is contacted by a cutting edge 34 of wheel 26 to produce scribe line 14. In order to produce a clean scribe line 14, back-up surface 32 is preferably hard, unyielding and flat. In the preferred embodiment, back-up surface 32 is hard steel. A downward force, indicated by an arrow 36 urges yoke 30 into contact with strip of amorphous metal alloy 10 to form scribe line 14.

I have discovered that a functional relationship exists between downward force 36 and a cutting edge radius 38. That is, as cutting edge radius 38 becomes greater with wear, more downward force 36 must be applied in order to obtain a satisfactory scribe line 14 for producing the slitting action. When cutting edge 34 is freshly sharpened, giving a cutting edge radius 38 which may be unmeasurably small, a very small value of downward force 36 is sufficient to produce a satisfactory scribe line 14. Using a tungsten carbide wheel 26 having a diameter of 35 mm, for example, a downward force 36 of about 9 Newtons is effective to produce a satisfactory scribe line 14 with a freshly sharpened cutting edge 34 in a strip of amorphous metal alloy 10 having a thickness of about 0.025 mm. The value of downward force 36 required increases with increasing cutting edge radius 38 to a value of downward force 36 of about 110 Newtons, at which time cutting edge radius 38 has degraded to slightly less than about 0.025 mm. A satisfactory range of values for downward force 36 may be from about 50 to about 100 Newtons to provide satisfactory scribing in a production environment. When cutting edge radius 38 further degrades beyond a value of about 0.038 mm, a satisfactory scribe line 14 cannot be made regardless of the value of downward force 36 applied. When cutting edge radius 38 wears beyond this value, sharpening or replacement is required. It should be noted that the limiting value of cutting edge radius 38 beyond which a satisfactory scribe line 14 cannot be produced is approximately equal to about 1.5 times the thickness of strip of amorphous metal alloy 10. This may be a satisfactory approximation for a relationship between a limiting value for cutting edge radius 38 and a thickness of strip of amorphous metal alloy 10 over a reasonable range of thicknesses of strip of amorphous metal alloy 10.

Referring now to FIG. 6, once a satisfactory scribe line 14 has been formed, part 16 and part 18 are folded toward each other by any convenient means with scribe line 14 inside. Scribe line 14 defines the fold so that strip of amorphous metal alloy 10 tends to fold accurately along it. I have discovered that attempting to fold strip of amorphous metal alloy 10 with scribe line 14 on the outside at this stage is not satisfactory since the fold does not tend to follow scribe line 14. Strip of amorphous metal alloy 10 is then creased along the fold by moving parts 16 and 18 toward each other to an effective degree of closeness at least in the vicinity of scribe line 14.

The folding and creasing may be performed by a conventional bending brake which folds one side against the other in a single motion or a pair of spaced-apart stationary or rotating mandrels used between which strip of amorphous metal alloy 10 is drawn. In this latter method, which is, in fact, the preferred embodiment of the method, folding is performed as strip of amorphous metal alloy 10 passes from wheel-type scribing tool 24 to the mandrels and the creasing occurs at a single point on strip of amorphous metal alloy 10 as that point passes the mandrels. Referring now also to FIG. 7, a pair of mandrels 40 and 42 are shown spaced apart and moving parts 16 and 18 of strip of amorphous metal alloy 10 toward each other along scribe line 14 as strip of amorphous metal alloy 10 is drawn between them. In the most preferred embodiment, mandrels 40 and 42 are a pair of opposed rotatable rollers. It is also possible to satisfactorily perform the folding operation manually using only the fingers.

I have discovered that part 16 and part 18 need not be moved together into face-to-face contact with each other for successful performance of the method. In fact, permitting face-to-face contact between part 16 and part 18 as strip of amorphous metal alloy 10 passes between mandrels 40 and 42 causes binding which prevents part 16 and part 18 from adjusting themselves in the direction of motion. This can tend to force the crease off the cutting line defined by scribe line 14. Thus, a spacing is preferably established between mandrels 40 and 42 which permits a space 44 to exist between facing surfaces of part 16 and part 18. Although an optimum value of space 44 may vary for different alloys and thicknesses of strip of amorphous metal alloy 10, for a thickness of about 0.038 mm with the alloy previously defined, I have discovered that a spacing between mandrels 40 and 42 of about three times the thickness of strip of amorphous metal alloy 10, or about 0.075 mm, is satisfactory. This allows space 44 to assume a value about equal to the thickness of strip of amorphous metal alloy 10.

Referring now to FIG. 8, after strip of amorphous metal alloy 10 is folded as hereinabove described, the crease is at least partly flattened out. As part 16 and part 18 move apart in the vicinity of the crease, strip of amorphous metal alloy 10 separates cleanly along scribe line 14 to provide two separate strips. Flattening can be performed in any convenient manner, but in the preferred embodiment, strip of amorphous metal alloy 10 is flattened at one end and then progressively flattened toward the other end as shown. The amount of flattening required varies with the sharpness of cutting edge radius 38. With a freshly sharpened cutting edge 34, parts 16 and 18 separate well before the crease is fully flattened out. As cutting edge 34 becomes duller, more and more flattening is required before separation occurs. To extend the life of wheel 26, it may be desirable not only to fully flatten the crease, but also, to at least partly reverse the crease. Such reversal may include, for example, moving parts 16 and 18 together with scribe line 14 on the outside defining the apex of a reverse fold. In an extreme case, parts 16 and 18 may be passed between a further pair of mandrels (not shown) which would complete the reversal by bringing the former outside surfaces of parts 16 and 18 close together at least in the vicinity of scribe line 14.

It should be noted that the progressive flattening illustrated in FIG. 8 is not in any way similar to the creasing and tearing process commonly used to separate a piece of paper and the like into two pieces. An attempt to tear strip of amorphous metal alloy 10 along creased scribe line 14 in this way produces irregular, and even a serrated, edges instead of the clean, flat edges produced by the method of the present invention.

When parts 16 and 18 separate from each other, separated edges 46 and 48 are preferably moved away from each other so that mechanical interlocking of edges 46 and 48 is avoided. One suitable apparatus for performing the scoring, folding, creasing, flattening and separating is disclosed in copending U.S. patent applicaton Ser. No. 574,234 (attorney's docket number 11-DTO-4706) filed on the same date as the present application and having a common assignee with the present application. The disclosure of the referenced U.S. patent application, although not needed for a full and complete disclosure of the present invention is referenced here and herein incorporated by reference since it incorporates one possible embodiment of apparatus which may optionally be employed to practice the present invention. When the scoring, folding, creasing and flattening is performed according to the present disclosure, edges 46 and 48 are clean without burrs, bumps or other artifacts of the slitting operation which would be detrimental to the space factor of a core wound from the separated strips.

The flattening and separating alluded to in the preceding paragraph can also be performed manually. In one manual separation technique, parts 16 and 18 are pulled laterally away from each other substantially as shown in FIG. 8 starting at one end and moving progressively to the other. When the length to be cut is relatively short such as, for example, when cutting across strip of amorphous metal alloy 10, I have discovered that it is only necessary to pull outward uniformly on the outer edges of parts 16 and 18. When an amount of pulling force is reached which is enough to sufficiently flatten the fold, the parts separate all along their lengths at substantially the same time in an almost explosive separation. An examination of the newly separated edges produced by this method shows that the same excellent edge cleanness is achieved as with the other flattening techniques.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What I claim is:

1. A method for slitting a strip of amorphous metal comprising:

(a) scribing a line in a first surface of said strip;

(b) folding the parts of said strip located on opposite sides of said scribed line toward each other along said line to form a folded strip having said line within the fold;

(c) moving said parts sufficiently close together adjacent said line to form a crease; and (d) at least partly flattening said crease whereby said strip separates into first and second strips on opposed sides of said line.

2. A method as defined in claim 1 wherein the step of at least partly flattening said crease includes at least fully flattening said crease.

3. A method as defined in claim 2 wherein the step of at least partly flattening said crease includes at least partly reversing said crease.

4. A method as defined in claim 1 wherein the step of scribing includes:

(a) backing up a second surface of said strip with a hard, unyielding back-up surface; and (b) scribing said line into said first surface without substantial removal of material from said strip.

5. A method according to claim 4 wherein the step of scribing said line includes forming a depression in said strip at said line.

6. A method according to claim 4 wherein the step of scribing said line includes compressing said amorphous metal along said line to form a depression along said line.

7. A method according to claim 4 wherein the step of scribing includes scribing with a wheel-type scribing tool.

8. A method according to claim 7 wherein said wheel-type scribing tool includes a cutting edge radius.

9. A method according to claim 8, further comprising maintaining said cutting edge radius less than about 0.038 mm.

10. A method according to claim 9 wherein the step of scribing further includes applying a scribing force on said wheel-type scribing tool of between about 5 and about 110 Newtons.

11. A method according to claim 7, wherein the step of scribing includes applying a scribing force on said wheel-type scribing tool of from about 5 to about 110 Newtons.

12. A method according to claim 1 wherein the step of creasing includes:

(a) spacing first and second parallel surfaces of first and second mandrels a predetermined distance apart; and (b) passing said strip between said first and second parallel surfaces.

13. A method according to claim 12 wherein the step of spacing includes spacing said first and second parallel surfaces at least a greater predetermined distance apart than twice a thickness of said strip.

14. A method according to claim 13 wherein said greater predetermined distance includes about three times a thickness of said strip.

15. A method according to claim 12 wherein said mandrels are rotatable mandrels.

16. A method according to claim 1 wherein the step of at least partly flattening includes progressively at least partly flattening said crease from one end to the other.

17. A method according to claim 16 wherein the step of progressively at least partly flattening includes at least partly reversing said crease from one end to the other.

18. A method according to claim 16 wherein the step of at least partly flattening further includes moving said first and second parts away from each other as they are separated whereby mechanical locking of cut edges thereof is avoided.

19. A part made by slitting a strip of amorphous metal by the method of claim 1.

20. A method for slitting a strip of amorphous metal comprising:

(a) backing up a first surface of said strip with a hard unyielding back-up surface;

(b) drawing a cutting edge of a wheel-type scribing tool along a cutting line on a second surface of said strip;

(c) applying a scribing force on said wheel-type scribing tool effective to compress a line of said amorphous metal beneath a cutting edge of said wheel-type scribing tool to thereby form a depressed scribed line between first and second parts of said strip located on opposite sides of said scribed line;

(d) spacing first and second parallel surfaces of first and second mandrels a predetermined distance apart;

(e) folding said first and second parts of said strip toward each other with said scribed line enclosed therebetween;

(f) drawing said strip between said first and second parallel surfaces whereby a crease is formed in said strip along said scribed line;

(g) progressively at least partly flattening said crease along said scribed line whereby said strip separates into first and second strips on opposed sides of said scribed line; and (h) moving said first and second strips away from each other during the step of progressively at least partly flattening whereby cut edges of said first and second strips are moved apart.

21. A part made by slitting a strip of amorphous metal by the method of claim 20.

* * * * *